United States Patent [19]

Aniszewski et al.

[11] 4,230,133

[45] Oct. 28, 1980

[54] HAIR CURLER

[76] Inventors: Bodo Aniszewski, Ahrensburger Weg 57, Hamburg; Willy Ehmann, Friedrichstrasse 8a, Heidelberg, both of Fed. Rep. of Germany

[21] Appl. No.: 899,846

[22] Filed: Apr. 25, 1978

[30] Foreign Application Priority Data

Apr. 30, 1977 [DE] Fed. Rep. of Germany ..... 2719344
May 20, 1977 [DE] Fed. Rep. of Germany ..... 2722976
Dec. 3, 1977 [DE] Fed. Rep. of Germany ..... 2753987

[51] Int. Cl.[3] ..... A45D 2/00
[52] U.S. Cl. ..... 132/40
[58] Field of Search ..... 132/40, 39, 42, 9

[56] References Cited

U.S. PATENT DOCUMENTS

| | | | |
|---|---|---|---|
| 235,680 | 12/1880 | Gray, Jr. | 132/40 |
| 762,246 | 6/1904 | McIntire | 132/40 |
| 789,686 | 5/1905 | Dunlap | 132/40 |
| 1,090,341 | 3/1914 | Pollard | 132/40 |
| 2,611,376 | 9/1952 | McIntyre | 132/40 |
| 3,660,634 | 5/1972 | Scott | 132/40 |

FOREIGN PATENT DOCUMENTS

| | | | |
|---|---|---|---|
| 565114 | 3/1958 | Belgium | 132/40 |
| 567387 | 5/1958 | Belgium | 132/40 |

*Primary Examiner*—G. E. McNeill
*Attorney, Agent, or Firm*—Kurt Kelman

[57] ABSTRACT

A hair curler of hairpin shape comprises two like rods extending in a longitudinal direction and being of rounded cross section in a plane transverse to the longitudinal direction. A bridge connects the rods at one of their ends and diametrically opposite outer sides of the rods are undulated. The undulated outer side of one rod defines troughs staggered in the longitudinal direction relative to the troughs defined by the undulated outer side of the other rod.

4 Claims, 8 Drawing Figures

HAIR CURLER

The invention relates to hair-curlers for water waving, hair setting or permanent waving.

Hair-curlers are available in many different constructions. The most usual hair-curlers consist of a relatively rigid material, such as wire mesh, or perforated plastics, in the form of a generally cylindrical hollow body, which is held fixed after rolling in the hair, for example, with a hairpin, a peg or clamps. With hair-curlers of this kind, the rolled-up hair is non-elastically stressed so that it can become brittle, with its springiness suffering.

Other known hair-curlers consist of a cylindrical foam body, which is held in the hair either by strips of bristles, or by clamps. With these forms, often the resilient compressibility, which is necessary for elastically stressing the hair sufficiently, is lacking.

Apart from the abovementioned disadvantages, which exist for use with all hair lengths, the cylindrical hair-curler bodies are particularly unsuitable for long hair because during the rolling-up, hair layer comes to lie on hair layer, so that the hair tips are especially tightly drawn, whereas the uppermost hair layers lie looser. Furthermore, after drying and removal of the haircurlers, the hair must be dressed by combing because the rolled-up hair tresses lie in separate rolls on the head during the curling.

Permanent waving curlers are known which consist of generally cylindrically formed rods, advantageously dog-bone shaped. Such a rod is turned in or rolled in the hair like a hair-curler, and retained by a rubber band which is fixed at one end of the rod and is attachable at its other end. The rubber band thus bears against the hair wound on the rod, so that usually the smoothness of the curling is interrupted at the pressure regions on the hair. Moreover, the danger exists that the hair is drawn too tight when rolling up, and then breaks. Finally, with these known permanent waving curlers, especially if long hair is to be treated, the outer region of the hair wound around the rod is more intensely moistened with the permanent waving liquid than the underneath layers, so that a non-uniform waving occurs and the hair is subjected to different conditions over its length.

It is an object of the invention to provide a hair-curler, more particularly for a permanent waving or water waving, with which the hair tresses can be wound up uniformly over their entire length, in any desired tress thickness, without the tension force necessary with the known hair curlers or permanent waving curlers, so as to ensure a uniform natural waving action, the hair tresses being able to be suitably shaped already during the winding up so that, after removal of the hair-curler, the hair simply needs to be combed to fall into attractive waves.

The invention consists in a hair-curler comprising two elastically yieldable or rigid rods or tubes which are connected together at one end by a bridge so as to have a hairpin-like shape, the hair-curler being mountable on a holding device by the end having the bridge or retainable with the bridge end close to the scalp of a user.

The bridge can be formed as an eye-member which is provided with an aperture through which a substantially rigid holding rod can be pushed with play.

The tubes or rods can consist of plastics, rubber or light metal. Their cross section may be oval or round or may have rounded-off corners.

The bridge can be a separate part, the limbs of which can be firmly plugged into the ends of the tubes or recess in the ends of the rods to be connected together, or the bridge can be formed integrally with the rods or tubes.

In a particular embodiment of the hair-curler of the invention, the rods are of undulating shape in the longitudinal direction at their diametrically oppositely lying outer sides, the undulations of one rod being arranged staggered relative to the undulations of the other rod.

The cross section of the rods, at the peaks of the undulations, may be oval or round. Moreover, the ends of the rods remote from the abovementioned bridge may be connectable by a removable connecting bridge, or (for helical winding of the tress) may have an integrally formed bridge.

Such a hair-curler can be considered as a loop winder or loop wave winder because the hair is not rolled up but is looped around the rods or tubes. The hair-curler according to the invention has essentially the form of a hairpin with a rigid connecting bridge and elastically resilient or rigid limbs. A hair tress is looped from above to below by figure of eight movements successively around the one and other rod of the "hairpin". For permanent waving, advantageously the rods or tubes are elastically yiedable and the spacing between them is not greater than their diameter. The resilient rods or tubes can spring apart somewhat during the looping, and thus facilitate the work. Hair wound up in loops in this manner is completely uniformly shaped along its entire length, and is neither tensioned nor stressed, so that a very natural wave fall is achieved and the danger of breaking by too strong a pull is practically excluded. The hair is protectively handled and, since hair layers do not lie on top of hair layers, it is uniformly wetted by the permanent waving liquid or, in the case of water waving, can be uniformly dried.

A hairpin shaped hair-curler can be used for loop winding of the hair for water waves. In such a hair-curler, the rods or tubes can be arranged at a wider spacing from each other than for the permanent waving curler. For water waving, rigid limbs of the "hairpin" are better suited than elastically yieldable rods or tubes, since with them the predetermined spacing can be maintained uniform. By the wider spacing of the limbs from each other, a springing apart of the limbs is not necessary during use. The limbs can be generally parallel to each other or may converge or diverge. The connecting bridge may be arcuate and is held by the hair at or near the scalp. The hair tress to be wound is drawn through the connecting bridge until the bridge is pushed close to the scalp. Then the hair tress is looped by figure of eight movements downwardly successively around the one and the other rod. The hair tips are fixed onto the rods by a clamp, a bridge member or some other holding means.

With hair-curlers with rods which are of undulating shape in the longitudinal direction, at their outer sides, the loop winding is facilitated and different manners of winding can be adopted. The undulation troughs precisely define the positions of the windings of the hair tress. The hair tress regions lying in the troughs moreover are held in position by the undulation peaks so that sliding-up of the windings is prevented.

Moreover, in this last-mentioned form of the hair-curler, the winding need not only be done in a figure of eight configuration, but can be done helically, since the hair tress can be helically wound only around the outer sides of the rods or tubes and thus come to lie in the troughs of the undulations.

In order to make the invention clearly understood, reference will now be made to the accompanying drawings which are given by way of example and in which.

Figure 1:
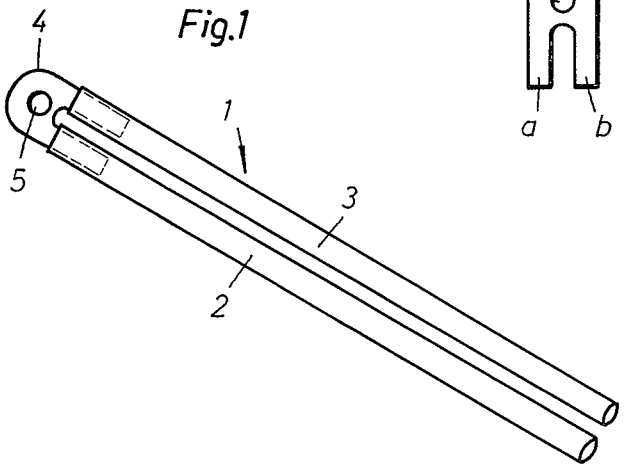
FIG. 1 is a perspective view of a hair-curler arranged as a loop winder.
Figure 2:
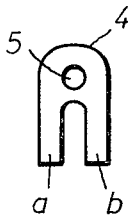
FIG. 2 is a detail view of a bridge member.
Figure 3:
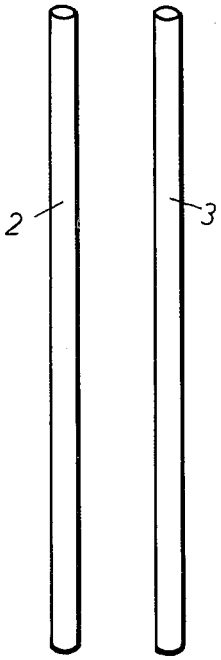
FIG. 3 illustrates two elastically yieldable rods or tubes of the hair-curler, to be connected by the bridge according to FIG. 2.

The hair-curler shown in FIGS. 1 to 4, which in the following will be referred to as a loop winder 1, consists of two elastically yieldable rods or tubes 2 and 3 which in the described embodiment are tubes of plastics or rubber. They are relatively rigidly connected to each other by means of a bridge 4 provided with a hole 5 which forms an eye. The bridge 4 consists of a hard material, for example, hard plastics. This hairpin shaped structure can be formed in one piece but the connecting bridge must have a hole or some other holding device in order that the loop winder 1 can be positioned and held during use.

The tubes 2 and 3 preferably have a diameter of four millimeters and a length of about ten to eleven centimeters. The spacing between the tubes 2 and 3 should be not greater than the diameter of the tubes. These dimensions are applicable particularly for loop wave winding for permanent waving of hair. They are not binding and can be varied according to requirements. With loop winding of the hair for water waving, preferably thicker tubes 2 and 3 are used. Plastics or rubber tubes are elastically bendable and pliable and are also relatively light, so that loop winders 1 made therefrom are useable with larger diameters. The cross section of the rods or tubes can be oval or round or may be angular so long as any corners are well rounded-off.

The bridge 4 has two limbs a and b which are plugged into ends of the tubes 2 and 3 with a firm fit.

A substantially rigid holding rod 6 is pushed through the hole 5 of each bridge 4 in such a manner that the loop winder 1 is slidable on the rod. On this holding rod 6, which for example is about twenty to thirty centimeters long, the required number of loop winders 1 are threaded. One end of the holding rod 6 is mounted on a support (not illustrated) resting on the neck of the person whose hair is to be waved in such a manner that the holding rod extends upwardly at an inclination.

The loop winders 1 can now be slid along the holding rod 6 to the required positions so that the corresponding hair tresses can be looped around the winder. After termination of the looping, the open end of the loop winder 1 or the region where the hair tress ends, is held together by a clamp, a gripping band, a bridge or some other holding device. The holding rod 6 with the loop winders 1 is arranged in the described manner around the entire rear region of the head.

Figure 4:
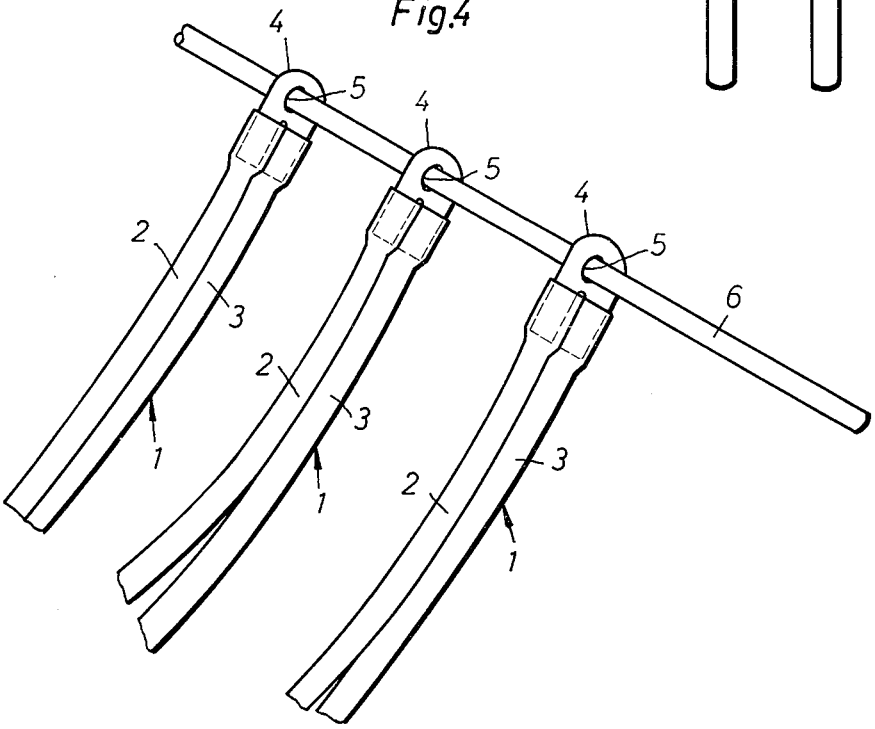
FIG. 4 is a perspective view of three of the hair-curlers threaded onto a holding rod.
Figure 5:
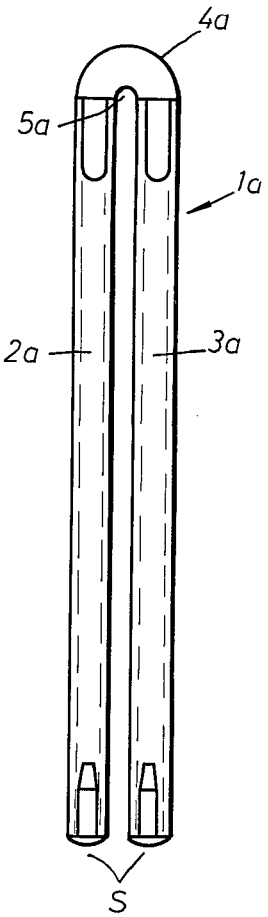
FIG. 5 is a view of another embodiment of a hair-curler.

The loop winder 1*a* shown in FIG. 5 is a simplified embodiment in which the inner rounding 5*a* of the bridge 4*a* serves as a holding formation which is positioned close to the scalp on the hair tress. In this embodiment, the holding rod 6 of FIG. 4 is not needed. Otherwise, this loop winder likewise consists of rods or tubes 2*a* and 3*a* which are connected together by the bridge 4*a*. If tubes 2*a* and 3*a* are used, their lower open ends can be closed by means of plugs S. Such plugs can also be used with curlers according to FIG. 1.

Figure 6:
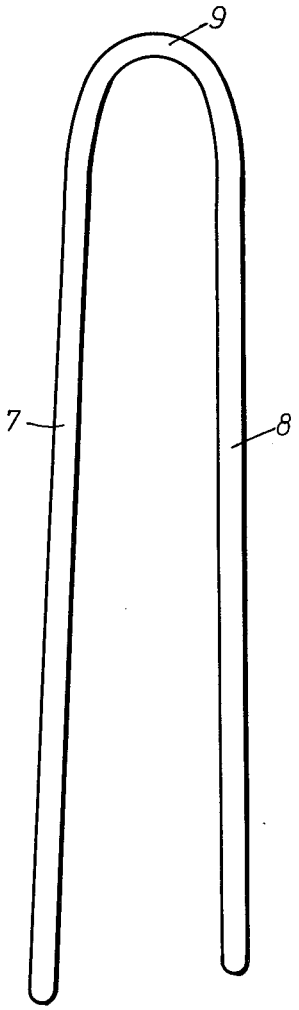
FIG. 6 is a view of a further embodiment of a hair-curler.

The hair-curler shown in FIG. 6 is more particularly provided for loop winding for water waving. It consists of rigid rods or tubes 7 and 8 the limbs of which form the "hairpin" and a bridge 9 connecting these limbs.

Figure 7:
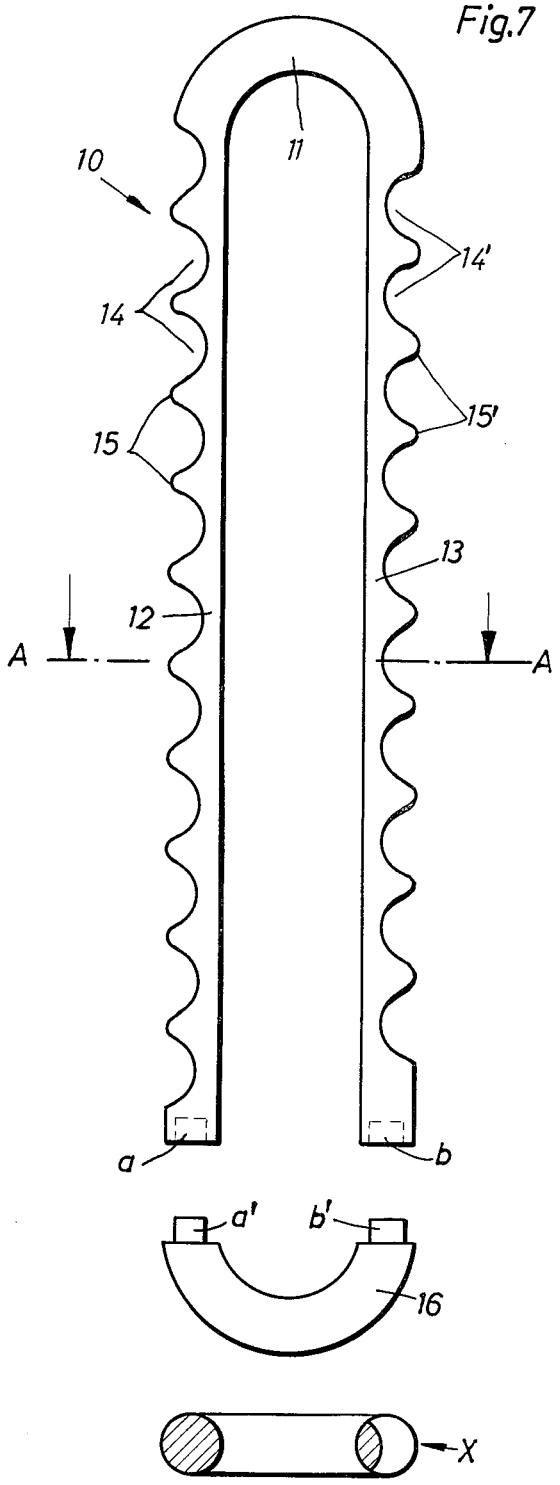
FIG. 7 is a side view of another hairpin shaped hair-curler with a separate connecting bridge for the lower ends of the rods.
Figure 8:
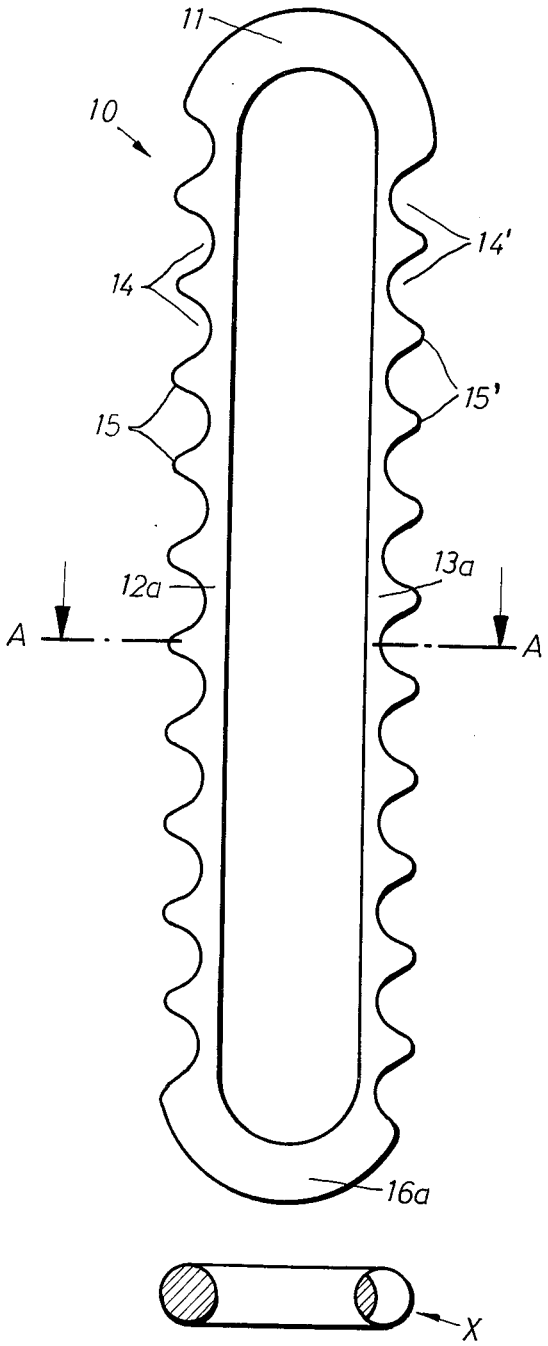
FIG. 8 is a side view similar to FIG. 7 but showing a unitarily formed lower connecting bridge.

The fourth embodiment of the hair-curler is shown in FIGS. 7 and 8, and is indicated by reference numeral 10. It comprises two rods 12 and 13, the cross-section of which is oval or round and which are connected to each other at their upper ends by a bridge 11. The bridge 11 is advantageously unitarily constructed with the rods 12 and 13, but it may alternatively be separable.

The diametrically oppositely lying outer sides of the rods 12 and 13 are of undulatory construction in the longitudinal direction, the undulation troughs 14 at the one outer side being arranged staggered relative to the undulation troughs 14' at the other outer side. Correspondingly, the undulation peaks or projections 15—15' are staggered. In this manner, the path for the hair tress to be wound is predetermined, and runs helically. The hair tress lies in the undulation troughs 14—14' and is held in position by the undulation peaks or projections 15—15'.

The lower ends of the rods 12 and 13 can likewise be connected together by a releasable or a unitarily formed bridge.

In FIG. 7 a releasable lower connecting bridge 16 is illustrated. In this embodiment, in each end surface of the lower free ends of the rods 12 and 13, recesses a and b are respectively provided in which the studs a' and b' fit, which are formed on the end surfaces of the limbs of the connecting bridge 16. The connection can, however, be performed in any other manner suitable for this purpose.

FIG. 8 shows a connection bridge 16*a* formed as one piece with the lower ends of the rods 12*a* and 13*a*. The principle of the winding and the function of the hair-curler are also in this case the same as for the embodiment according to FIG. 1.

With this hair-curler the hair tress can also be wound in helical form, that is to say not in a figure of eight path. The tress is gripped near the scalp and wound helically into the undulation troughs 14—14'. In this manner a kind of corkscrew curl can be obtained. Thus, this embodiment of the hair-curler of the invention is more versatile than those with smooth rods or tubes.

The illustration X in both FIGS. 7 and 8 is a sectional view through the hair-curler 10 in the direction of the arrow A—A. The illustrated cross section is round but alternatively it can be oval. An angular cross section is not advantageous since the corners of such rods are unfavourable to the hair. Care should thus be taken that the rods do not have any corners, or in any case have only well rounded-off corners. The rods can be hollow, i.e. constructed in the form of tubes.

The winding path formed by the staggered undulations can be uniform, that is to say the distances between the undulation peaks 15, 15' may be equal, or the distances may increase, from the top to the bottom or from the bottom to the top.

What I claim is:

1. A hair curler comprising two like rods extending in a longitudinal direction from one end to another end and a bridge connecting the one ends of the rods to form a hairpin-like shape, the rods being of rounded cross section in a plane transverse to the longitudinal direction and diametrically opposite outer sides of the rods being undulated, the undulated outer side of one of the rods defining troughs staggered in the longitudinal direction relative to the troughs defined by the undulated outer side of the other rod.

2. The hair curler of claim 1, wherein the bridge is a resilient arcuate member.

3. The hair curler of claim 1, comprising a further bridge connecting the other ends of the rods.

4. The hair curler of claim 1 or 3, wherein at least one of the bridges is removably connected to the rods.

* * * * *